US005992964A

United States Patent [19]

Yamaguchi

[11] Patent Number: 5,992,964

[45] Date of Patent: Nov. 30, 1999

[54] INK JET RECORDING APPARATUS WITH MEANS FOR STOPPING PRINTING AND INK JETTING CAPABILITY MAINTAINING OPERATIONS FOR ONE NOZZLE OPENING ROW DURING A PRINTING OPERATION FOR ANOTHER ROW

[75] Inventor: Shuichi Yamaguchi, Nagano, Japan

[73] Assignee: Seiko Epson Corporation, Tokyo, Japan

[21] Appl. No.: 08/783,897

[22] Filed: Jan. 16, 1997

[30] Foreign Application Priority Data

Jan. 16, 1996 [JP] Japan ..... 8-023071

[51] Int. Cl.[6] ..... B41J 2/165

[52] U.S. Cl. ..... 347/23

[58] Field of Search ..... 342/23, 22, 14, 342/35; 347/22, 23, 14, 35

[56] References Cited

U.S. PATENT DOCUMENTS

| | | | |
|---|---|---|---|
| 4,734,718 | 3/1988 | Iwagami et al. | 347/28 |
| 4,970,527 | 11/1990 | Gatten | 347/35 |
| 5,018,884 | 5/1991 | Hirano et al. | 347/43 |
| 5,153,614 | 10/1992 | Yamaguchi et al. | 347/30 |
| 5,341,163 | 8/1994 | Hanabusa | 347/30 |

FOREIGN PATENT DOCUMENTS

| | | | |
|---|---|---|---|
| 0331481 | 9/1989 | European Pat. Off. . | |
| 0585923 | 3/1994 | European Pat. Off. . | |
| 0630754 | 12/1994 | European Pat. Off. . | |
| 64-40342 | 2/1989 | Japan | B41J 3/04 |

OTHER PUBLICATIONS

Japanese Patent Abstract, JP 06 008458, Shinohara Isato, Jan. 18, 1994 "Driving method for ink jet recording head".

Japanese Patent Abstract, JP 04 348951, Mogi Nobuhiro, May 28, 1991, "Image Recording device".

*Primary Examiner*—N. Le
*Assistant Examiner*—Thien Tran
*Attorney, Agent, or Firm*—Sughrue, Mion, Zinn, Macpeak & Seas, PLLC

[57] ABSTRACT

An ink jet recording apparatus including: a printing head having a plurality of nozzle opening rows, the nozzle opening rows jetting ink drops separately from each other; a cap for selectively sealing the plurality of nozzle opening rows and a pressure device for forcibly discharging ink from the plurality of nozzle opening rows; and control means for causing the cap to seal the nozzle opening rows and the pressure device to forcibly discharge ink from the nozzle opening rows to perform a jetting recovery operation when an electric power is turned on or at a print start time, for causing ink drops to be jetted from the nozzle opening rows based on print data to perform a printing operation and stopping the printing operation for performing an ink jetting capability maintaining operation of the nozzle opening rows, and further causing the cap to seal the nozzle opening rows and the pressure device to forcibly discharge ink from the nozzle openings to perform the jetting recovery operation, wherein the controller stops the printing operation and the ink jetting capability maintaining operation with respect to at least one of the plurality of nozzle opening rows during the printing operation for another one of the plurality of nozzle opening rows.

15 Claims, 13 Drawing Sheets

FIG. 6

| RECOVERY OPERATION OF FIRST PRINTING HEAD | |
|---|---|
| tm<TM1 | N1 TIMES OF IDLE INK DROP JETTING |
| TM1>tm>TM2 | N2 TIMES OF IDLE INK DROP JETTING |
| tm>TM2 | FORCIBLY DISCHARGED INK AMOUNT Tm1 |
| JETTING CAPABILITY MAINTAINING OPERATION OF FIRST PRINTING HEAD | |
| t1<2 | 5 TIMES OF IDLE INK DROP JETTING |
| 2<t1<2.5 | 10 TIMES OF IDLE INK DROP JETTING |
| 2.5<t1<3 | 15 TIMES OF IDLE INK DROP JETTING |
| RECOVERY OPERATION OF SECOND PRINTING HEAD | |
| tm<TM3 | N3 TIMES OF IDLE INK DROP JETTING |
| TM3>tm>TM4 | N4 TIMES OF IDLE INK DROP JETTING |
| tm>TM4 | FORCIBLY DISCHARGED INK AMOUNT Tm2 |
| JETTING CAPABILITY MAINTAINING OPERATION OF SECOND PRINTING HEAD | |
| t2<6 | 10 TIMES OF IDLE INK DROP JETTING |
| 6<t2<7 | 15 TIMES OF IDLE INK DROP JETTING |
| 7<t2<8 | 20 TIMES OF IDLE INK DROP JETTING |
| 8<t2<9 | 25 TIMES OF IDLE INK DROP JETTING |

START
(a)
PRINT SIGNAL INPUT ?
NO
YES
TO B
(b)
SET STORED MODE TO CURRENT MODE
(c)
PRINT MODE CHANGE ?
NO
YES
(d)
BYMC→B
NO
YES
(e)
B→BYMC
NO
YES
(f)
BYMC→YMC
NO
YES
(g)
YMC→BYMC
NO
YES
(h)
YMC→B
NO
YES
(i)
EXECUTE OPERATION 1
(j)
EXECUTE OPERATION 2
(k)
EXECUTE OPERATION 3
(l)
EXECUTE OPERATION 4
(m)
EXECUTE OPERATION 5
(n)
EXECUTE OPERATION 6
(o)
WRITE CHANGE MODE
(p)
RESET TM TIMER ; START TM TIMER
TO A

INK JET RECORDING APPARATUS WITH MEANS FOR STOPPING PRINTING AND INK JETTING CAPABILITY MAINTAINING OPERATIONS FOR ONE NOZZLE OPENING ROW DURING A PRINTING OPERATION FOR ANOTHER ROW

BACKGROUND OF THE INVENTION

This invention relates to an ink jet recording apparatus having a plurality of ink jet printing heads moving in the width direction of a recording paper for jetting ink of different colors to the recording paper in order to print color image, the ink jet printing heads being mounted on a single carriage for enabling printing at a high density, and more particularly to a management technique appropriate for such a recording apparatus.

A recording apparatus having ink jet printing heads produces comparatively little noise during printing and can form small dots at a high density. Accordingly, such an apparatus is used for various types of color printing.

Since the recording apparatus jets ink, which is pressurized in a pressure generation chamber to recording paper as ink drops from nozzles for forming dots, it is necessary to prevent the ink from running on the recording paper in order to improve the print quality. The percentage of an ink solvent is made as small as possible and a material that is easily evaporated is used.

Since, an ink solvent is evaporated from the nozzle openings during printing, ink viscosity rises. If the nozzle face is sealed with a cap the ink viscosity in the nozzle openings still rises, and therefore jetting of ink is hindered.

To solve such a problem, a printing head is moved to an ink receptacle provided in a non-print area and ink is jetted from all nozzle openings at the expiration of a predetermined time interval during printing, for example, as disclosed in Japanese Patent Application Laid-Open No. Sho. 64-40342.

Since graphics processing can be executed comparatively easily as personal computers have developed, a printer that can output a hard copy of a color image displayed on a display is required. An ink jet printer that can execute color printing comprises a printing head for black printing and a printing head for color printing both mounted on a carriage taking into account the ink consumption amount difference and the recording density difference between colors and prevention of mixing colors at a stop time.

Although such an ink jet printer can execute text printing and color graphics printing on the same page, the user might want to use the ink jet printer to execute only monochrome printing in black ink for a long time or to execute only color printing in cyan, magenta, and yellow color inks for a long time.

In such a case, since the other printing head not involved in printing, for example, the color printing head during text printing, does not jet ink drops, ink dries in the nozzle openings in an extremely short time, clogging the nozzle openings.

To solve such a problem, normally, upon the expiration of a predetermined time interval, the printing head not involved in the print operation is moved to a non-print area and is made to an perform idle jetting operation jetting ink drops from the nozzle openings for in order to prevent dried ink from clogging the nozzle openings.

However, when ink used with one printing head differs from ink used with the other in an ink drying degree, even if one printing head is executing printing, idle jetting for the other must be performed. As a result, the printing speed is lowered and ink for the other printing head not involved in printing is consumed by the idle jetting.

SUMMARY OF THE INVENTION

It is therefore an object of the invention to provide a new ink jet recording apparatus that can avoid the need to lower the recording speed and lessen the amount of ink consumed by the flushing operation.

To achieve these objects, there is provided an ink jet recording apparatus including: a printing head having a plurality of nozzle opening rows, the nozzle opening rows jetting ink drops separately from each other; a cap for selectively sealing the plurality of nozzle opening rows and a pressure device for forcibly discharging ink from the nozzle opening rows; and a controller for causing the cap to seal the nozzle opening rows and the pressure device to forcibly discharging ink from the nozzle opening rows to perform a jetting recovery operation when an electric power is turned on or at a print start time, for causing jetting of ink drops from the nozzle opening rows based on print data to perform a printing operation and stopping the printing operation for performing an ink jetting capability maintaining operation of the nozzle opening rows, and further causing the cap to seal the nozzle opening rows and the pressure device to forcibly discharge ink from the nozzle openings to perform the jetting recovery operation, wherein the controller stops the printing operation and the ink jetting capability maintaining operation with respect to at least one of the plurality of nozzle opening rows during the printing operation for another row.

The printing operation of a nozzle opening row not involved in printing is stopped and jetting of ink drops to prevent the nozzle openings from being dried is stopped, thereby suppressing the time required for preventing the nozzle openings from being dried and also useless ink consumption.

BRIEF DESCRIPTION OF THE DRAWINGS

FIG. 6 is a schematic diagram of one embodiment of maintenance data storage means in the ink jet recording apparatus;

DETAILED DESCRIPTION OF THE PREFERRED EMBODIMENTS

Referring now to the accompanying drawings, there are shown preferred embodiments of the invention.

Figure 1:
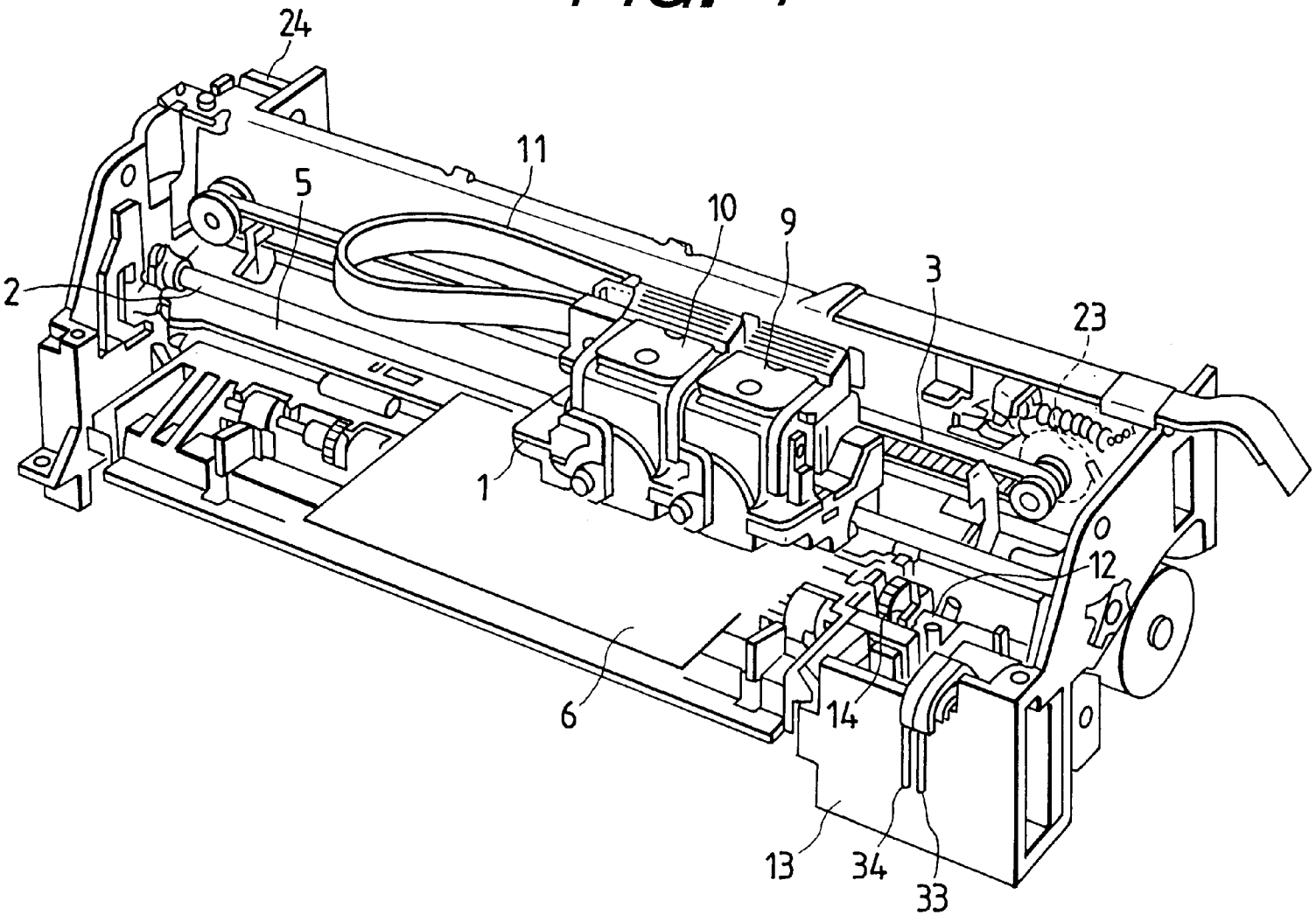
FIG. 1 is a perspective view to show the structure of the print mechanism periphery of an ink jet recording apparatus of the invention.

FIG. 1 shows an outline of the print mechanism periphery of an ink jet recording apparatus of the invention. A carriage 1 is supported on a guide member 2 and connected to a pulse motor 23 by a timing belt 3. The carriage reciprocates in parallel with a platen 5.

The carriage 1 comprises a first ink jet printing head 7 having a nozzle opening row for jetting ink (in the embodiment, black ink) and a second ink jet printing head 8 having a nozzle opening row for jetting three color inks of cyan, magenta, and yellow (FIG. 4), the first and second printing heads 7 and 8 being spaced from each other at a given interval in the moving direction of the carriage 1. A black ink cartridge 9 and a color ink cartridge 10 are detachably mounted above the first and second printing heads 7 and 8. A capping unit 12 for sealing the printing heads 7 and 8 is disposed in an area outside a print area.

A cleaning member 14 comprising a felt board and a rubber board laminated on each other is placed in a non-print area opposite to the passage of the printing heads 7 and 8 (in the embodiment, in the proximity of the capping unit 12). As is known, at the cleaning time, the cleaning member 14 projects to the side of the printing head 7, 8 and comes in contact with the printing head 7, 8, then brings either of the felt board and the rubber board into contact with a nozzle plate of the printing head 7, 8 depending on the moving direction of the printing head 7, 8, for removing an ink residue, paper powder, etc., in the nozzle openings and in the proximity thereof.

Upon reception of a drive signal from a head drive circuit (not shown) via a flexible cable 11, the printing head 7 or 8 forms black or color dots on recording paper 6 facing the printing head while receiving an ink supply from the ink cartridge 9 or 10.

Figure 2:
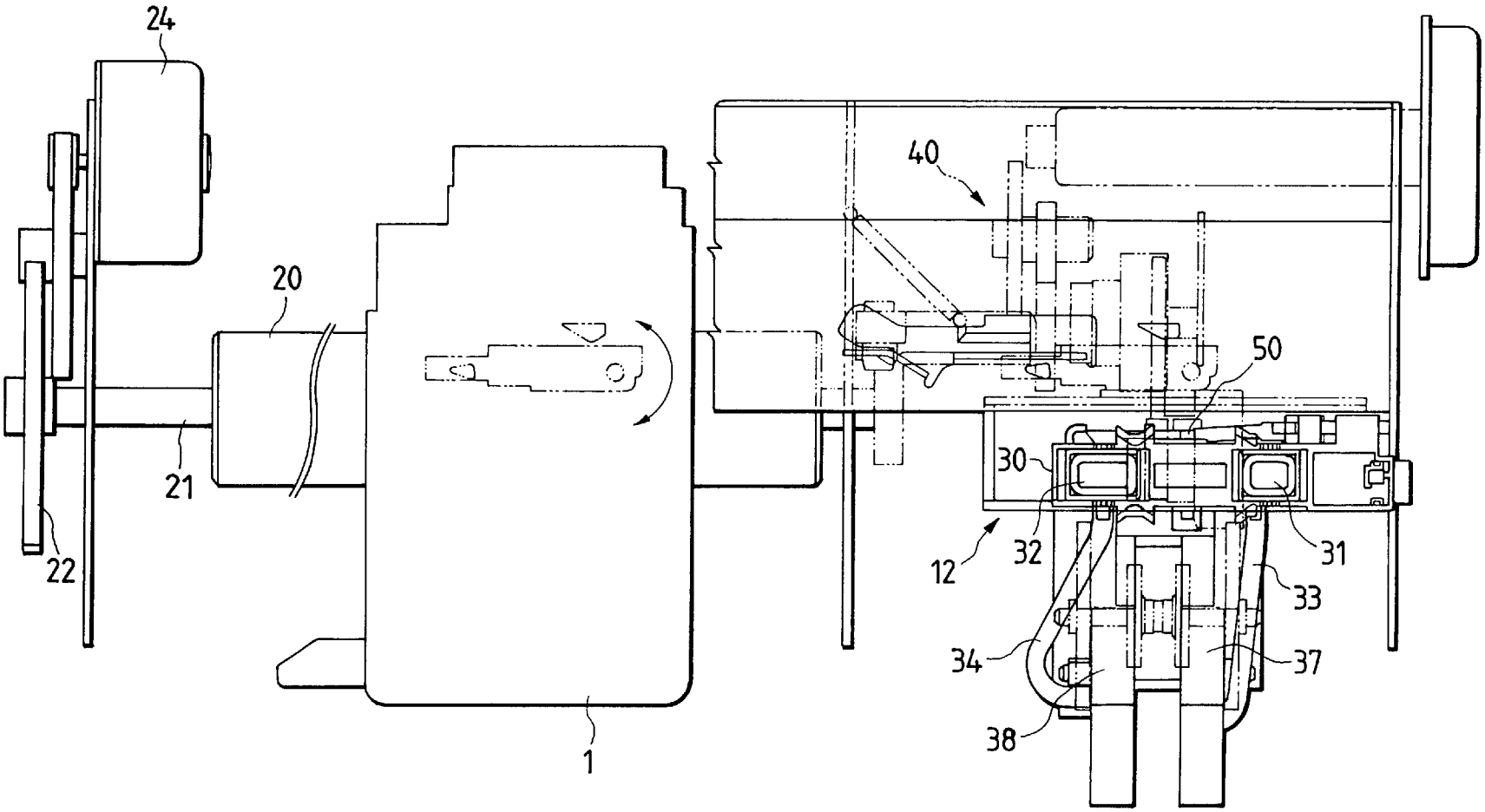
FIG. 2 is a top view to show the print mechanism periphery centering around a capping unit.

FIG. 2 is a view to show the top face in the proximity of the capping unit 12. A paper feed roller 20 is connected to a pulse motor 24 for both paper feed and pump drive by a gear 22 fixed to one end of a rotation shaft 21 for transporting recording paper 6 in accordance with a print process.

The above-mentioned capping unit 12 comprises first and second cap members 31 and 32 made of elastic material disposed on a slider 30 occupying a capping position covering the nozzle opening faces of the printing heads 7 and 8 and a non-capping position away from the nozzle opening faces in association with a move of the carriage 1. These cap members 31 and 32 comprise opening areas capable of sealing the printing heads 7 and 8 in a state in which they are in intimate contact with the first and second printing heads 7 and 8 corresponding thereto and capable of reliably receiving ink drops jetted from the printing heads 7 and 8 in a state in which they face the printing heads 7 and 8 with a given spacing.

The first cap member 31 (second cap member 32) has a suction port 31*a* (32*a* (FIG. 3)) connected to one end of a tube 33 (34) forming a part of a pump 37 (38) for receiving a suction force.

The first and second tube pumps 37 and 38 are selectively connected to the pulse motor 24 by a wheel train 40, When the motor 24 turns reversely, only the first tube pump 37 performs the suction operation and when the motor 24 turns forward, only the second tube pump 38 performs the suction operation.

Figure 3:
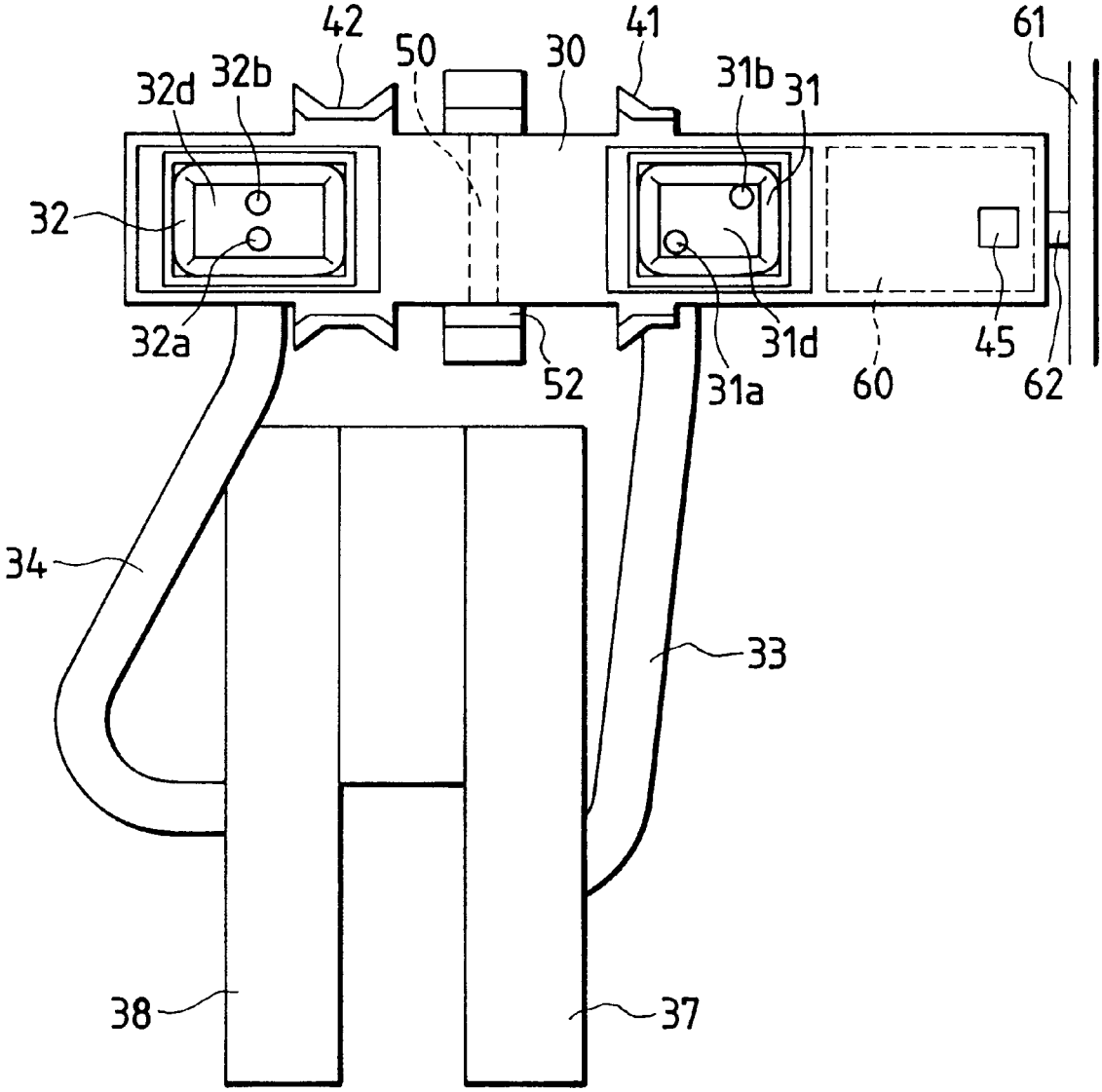
FIG. 3 is a top view to show one embodiment of the capping unit.
Figure 4:
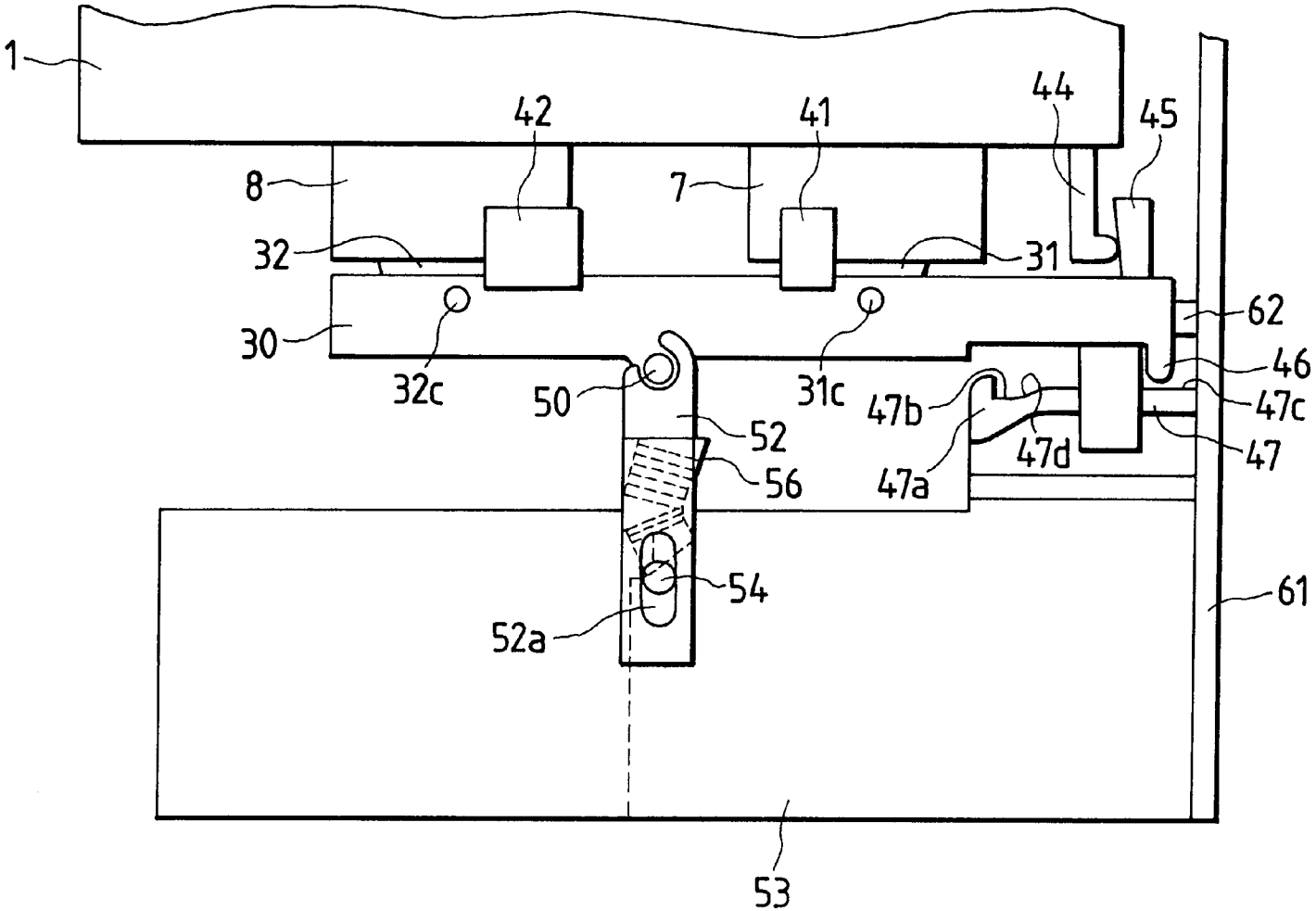
FIG. 4 is a front view to show the embodiment of the capping unit in a state in which the capping unit is abutted against printing heads.

FIGS. 3 and 4 show one embodiment of the capping unit 12, wherein the slider 30 comprises the first and second cap members 31 and 32 that are disposed swingably about shafts 31*c* and 32*c* matching the spacing between printing heads 7 and 8 mounted on a carriage 1.

First and second guide pieces 41 and 42 are placed on both sides matching the widths of the printing heads 7 and 8 of the carriage 1 and are disposed with a spacing capable of facing the printing heads 7 and 8 when the carriage 1 is set to a predetermined position. The slider 30 is formed at the tip (the right end) with a flag piece 45 abutting a projection 44 at the lower end of the carriage 1 when the carriage 1 moves to a position where the first and second cap members 31 and 32 face the first and second printing heads 7 and 8. An engagement member 46 is disposed at the tip of the slider 30 beyond the flag piece 45 and abuts or comes off a guide member 47 attached to a base 53.

The guide member 47 is formed with a convex part 47*a* for preventing the slider 30 from slipping out, a plane 47*b* for forming a given space appropriate for idle jetting between the slider 30 and the printing heads 7 and 8, a plane 47*c* for bringing the cap members 31 and 32 into elastic contact with the printing heads 7 and 8, and a slope 47*d* for connecting the planes 47*b* and 47*c*.

On the other hand, the slider 30 is provided at the center of the bottom with a shaft 50 orthogonal to the moving direction of the carriage 1, and the shaft 50 loosely engages on both sides a lever 52 having a lower end attached swingably to a shaft 54 of the base 53 via a long groove 52*a*. The slider 30 is attached to the top end of a coil spring 56 fixed at the lower end to the base 53, inclined to the print area side, and set slightly like buckling on the non-print area side.

Thus, at the non-capping time, the slider 30 is energized by the coil spring 56 toward the print area side while it is regulated at one end by the lowest end of the slope 47*b* of the guide member 47 and at the center by the lever 52, and can form a spacing appropriate for idle jetting without bringing the cap members 31 and 32 into contact with the printing heads 7 and 8.

The slider 30 is provided on the side of a case 61 with a valve unit 60 communicating with air openings 31*b* and 32*b* made in the cap members 31 and 32, and an operation rod 62 is projected from the valve unit 60, whereby the slider 30 can be moved to the capping position for bringing the operation rod 62 into elastic contact with the case 61, thereby closing the normally open valve unit 60 for closing the air openings 31*b* and 32*b*.

Figure 5:
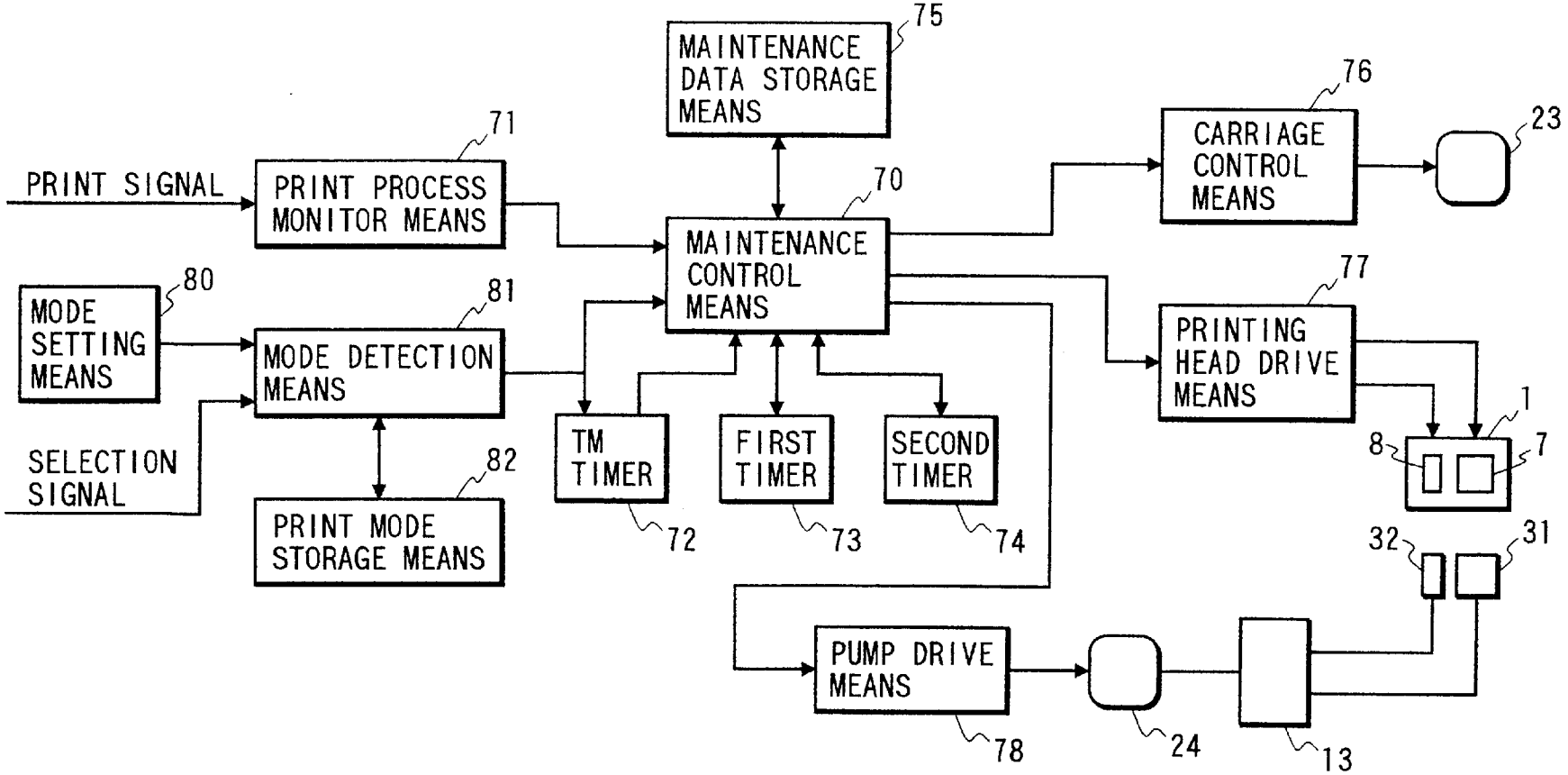
FIG. 5 is a block diagram to show one embodiment of the invention.

FIG. 5 shows one embodiment of a control system, wherein reference numeral 70 designates maintenance control means for monitoring the current position of the carriage 1 upon reception of a signal from print process monitor means 71 and operating carriage control means 76, printing head drive means 77, and pump drive means 78 for idly jetting ink from the printing head 7, 8 and for capping the printing head 7, 8 with the cap member 31, 32 and forcibly discharging ink according to data stored in maintenance data storage means 75 (described later) based on time count data of a TM timer 72, a first timer 73, and a second timer 74 (described later).

The maintenance control means 70 also has a function of selectively causing only the printable printing head to perform the suction operation of sealing the printing head 7, 8 with the cap member 31, 32 and giving a negative pressure for forcibly discharging ink from nozzle openings when the power is turned on or during the stop period, and causing the printing head in a stop state to skip the suction operation.

The TM timer 72 counts non-operation time tm of either the printing head 7 or 8 placed in a non-operation mode by mode setting means 80 described later.

The first and second timers 73 and 74 are reset when the first and second printing heads 7 and 8 perform idle jetting respectively during the print process, and they count the elapsed time since the previous idle jetting.

The maintenance data storage means 75 stores head recovery operation data comprising the numbers of ink drops to be idly jetted in response to the time tm counted by the TM timer 72, N1, N2, N3, and N4, and the amounts of ink to be forcibly discharged from the nozzle openings by giving a negative pressure by the cap members 31 and 32, Tm1 and Tm2, and printing head jetting capability maintaining operation data comprising the numbers of ink drops to be jetted in response to the times counted by the first and second timers 73 and 74, t1 and t2, as shown in FIG. 6.

Referring again to FIG. 5, numeral 80 is the abovementioned mode setting means for setting a first print mode using both the printing heads 7 and 8 at the same time for printing, a second print mode for deactivating the second printing head 8 jetting YMC (Yellow, Magenta and Cyan) color ink for performing only monochrome printing, or a third print mode for printing only in YMC color ink without using black ink and specifying whether idle jetting executed for preventing the nozzle openings from being clogged at the printing time is to be executed for all the printing heads including the printing head set to the non-operation mode or to be skipped for the printing head set to the non-operation mode.

Numeral 81 is a mode detection means for setting the contents stored in print mode storage means 82 as a default operation at the next starting time, if the user changes the mode through the mode setting means 80 made up of selection switches, etc., placed on the cabinet of the recording apparatus, for storing the changed mode in the print mode storage means 82, setting periods T1 and T2 for performing idle jetting to maintain the printing head jetting capability of the printing heads used for printing, and setting an infinite period so as to skip idle jetting for the printing head set to the non-operation mode.

The operation of the recording apparatus thus constructed will be discussed with reference to flowcharts shown in FIGS. 7 to 15.

I. When the previous mode is a color print mode using black ink, namely, a print mode using black ink and YMC color ink and the present mode is also a print mode wherein both the first and second printing heads are activated:

When the power is turned on, the stop period is determined according to time count data from a stop timer (not shown) and if the stop time is long, the first and second printing heads 7 and 8 are capped with the cap members 31 and 32 and the pumps 37 and 38 are operated for forcibly discharging ink drops from the printing heads 7 and 8, thereby recovering the ink jetting capability.

Figure 7:
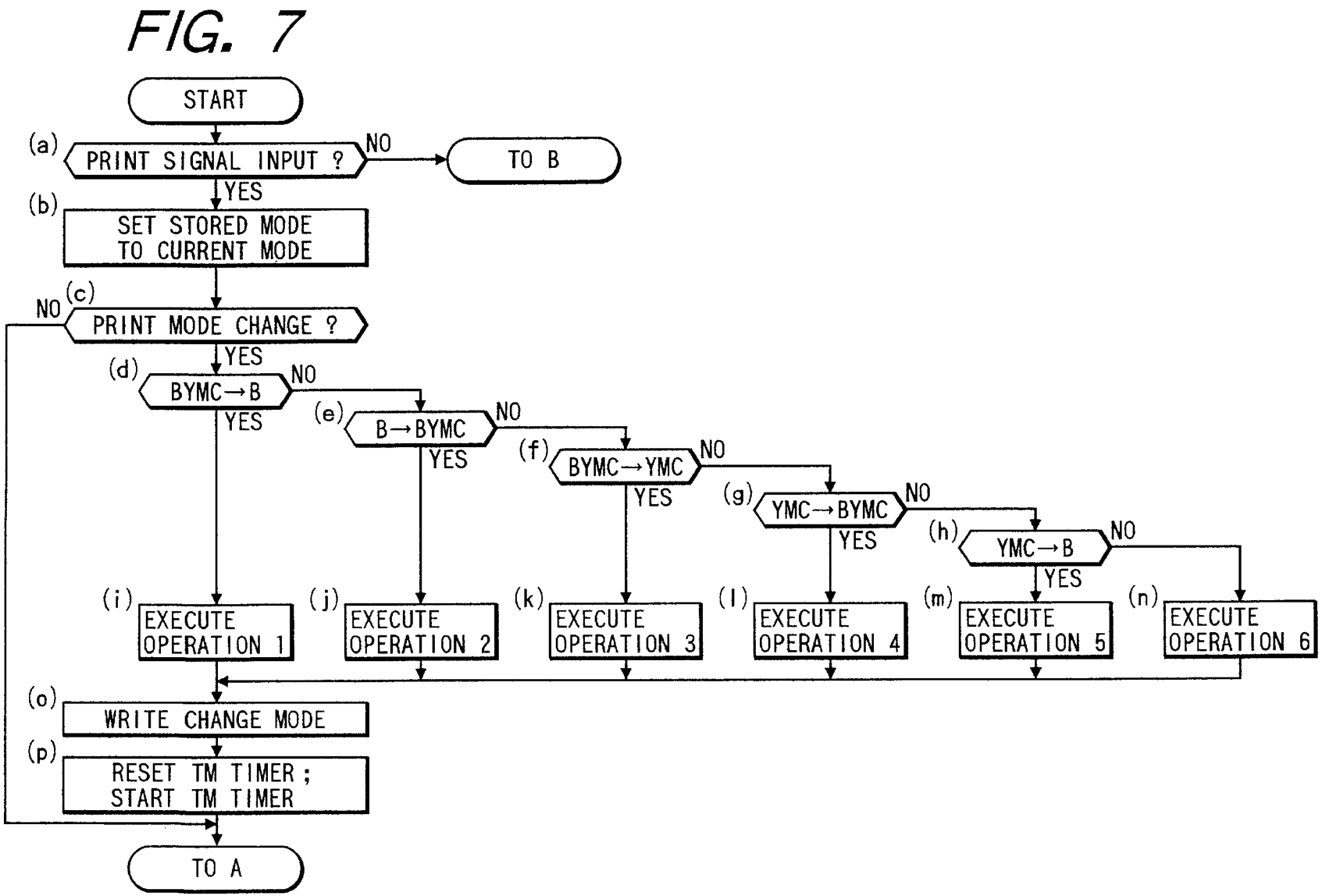
FIG. 7 is a flowchart to show a print mode determination process in the operation of the ink jet recording apparatus.

When a print signal is input at step a in FIG. 7, as required, the first and second printing heads 7 and 8 are capped with the cap members 31 and 32 and the pumps 37 and 38 are operated for forcibly discharging ink drops from the printing heads 7 and 8, thereby recovering the ink jetting capability.

At the termination of such preprocessing, the print mode detection means 81 sets the mode stored in the print mode storage means 82 to the current mode at step b in FIG. 7. In this state, if the mode is not changed within a predetermined time at step c in FIG. 7, control jumps to step a in FIG. 8 at which the first and second timers 73 and 74 are reset and started.

Figure 8:
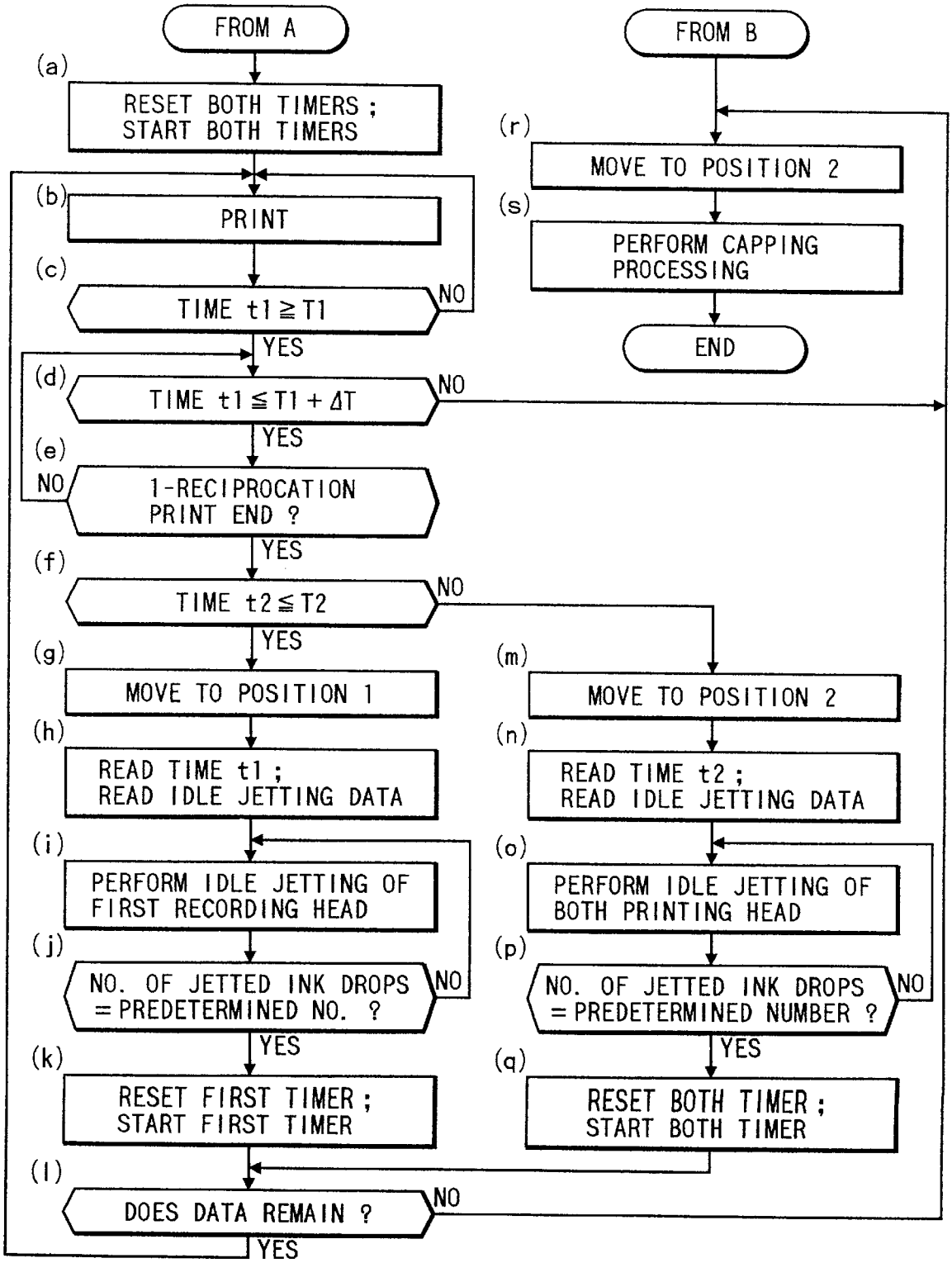
FIG. 8 is a flowchart to show an ink jetting capability maintaining process in a print process in the operation of the ink jet recording apparatus.

In this state, when print data is input, black ink is jetted from the nozzle openings of the first printing head 7 and YMC color ink is jetted from the nozzle openings of the second printing head 8 and printing is started at step b in FIG. 8.

When the first timer 73 counts the shortest idle jetting period T1, for example, two seconds during the print operation at step c in FIG. 8, the maintenance control means 70 waits for a one reciprocation end signal from the print process monitor means 71 at step e in FIG. 8.

If 1-reciprocation printing terminates at step e in FIG. 8 before the expiration of predetermined time required for 1-reciprocation printing, ΔT, for example, one second at step d in FIG. 8 after the first timer 73 counts the shortest idle jetting period, two seconds, the maintenance control means 70 compares the time count data t2 of the second timer 74 with the shortest idle jetting period T2 of the second printing head 8 stored in the maintenance data storage means 75 (in the embodiment, six seconds) at step f in FIG. 8.

In this case, since the reciprocating printing is terminated at a lapse of two seconds since the start of the printing, the time has elapsed by ΔT; after all, the time of only 2.5 seconds has elapsed since the start of the printing. Thus, the maintenance control means 70 causes the carriage control means 76 to move the first printing head 7 to position 1 (c in FIG. 15) facing the second cap member 32 positioned on the print area side at step g in FIG. 8.

In this state, the maintenance control means 70 reads the number of ink drop jetting times corresponding to the time counted by the first timer 73, t1=2.5 seconds, (in the embodiment, 15) from the maintenance data storage means 75 at step h in FIG. 8 and causes the printing head drives means 77 to jet ink drops from all nozzle openings of the first printing head 7 at step i in FIG. 8. At the termination of 15 times of ink drop jetting, the maintenance control means 70 causes the printing head drive means 77 to stop jetting ink at step j in FIG. 8.

Thus, the amount of ink corresponding to how much the nozzle openings are dried is jetted and an increase in viscosity of ink in the nozzle openings from which no drops of ink are jetted in the print process is canceled reliably.

If the first timer 73 counts (shortest jetting period +ΔT) while a wait is made for 1-reciprocation printing to terminate at step e in FIG. 8, a failure, etc., is possible. Thus, a move is made to position 2 (d in FIG. 15) at step r in FIG. 8 and capping processing is performed at step s in FIG. 8, then a standby mode is entered.

When idle jetting of the first printing head 7 terminates, the maintenance control means 70 resets only the first timer 73 and causes it to again start counting the time at step k in FIG. 8. In this case, print data remains at step 1 in FIG. 8 because of idle jetting during the printing. Therefore, the carriage 1 is moved to the print area and printing is restarted at step b in FIG. 8.

When again the first timer 73 counts the shortest idle jetting period T1 at step c in FIG. 8 in the next print process, control goes to step f via steps d and e.

Figure 13:
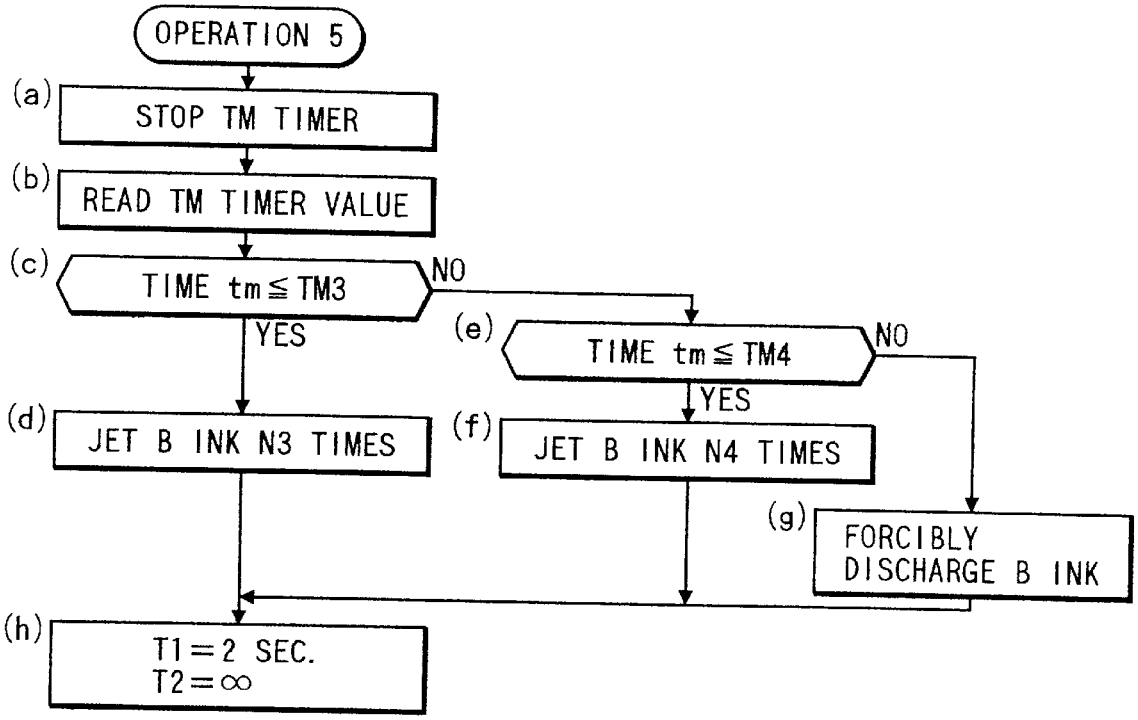
FIG. 13 is a flowchart to show a process of operation 5 in print mode.

In this case, the shortest idle jetting period T2 for the second printing head 8, six seconds, has already elapsed since the start of the printing at step f in FIG. 13, the maintenance control means 70 moves the carriage 1 to position 2 (d in FIG. 15) at step m in FIG. 8, whereby the first and second printing heads 7 and 8 face the cap members 31 and 32 with a given spacing.

In this state, the maintenance control means 70 reads the elapsed time t1 since the previous idle jetting of the first printing head 7 from the first timer 73, the elapsed time t2 since the idle jetting of the second printing head 8 from the second timer 74, and the numbers of idly jetted ink drops of the printing heads 7 and 8 corresponding to the times t1 and t2 from the maintenance data storage means 75 at step n in FIG. 8.

Drive signals indicating the numbers of ink drops to be jetted by the printing heads 7 and 8 are output to the printing heads 7 and 8 for jetting ink drops from all the nozzle openings of the first and second printing heads 7 and 8 at step o in FIG. 8. At the termination of jetting as many ink drops as indicated by the drive signals, the idle jetting is stopped at step p in FIG. 8.

At the termination of the idle jetting, the maintenance control means 70 resets the first timers 73 and 74, then again causes the timers to start counting the time at step q in FIG. 8.

After this, the printing is continued while the steps are repeated. When print data runs out at step 1 in FIG. 8, the carriage 1 is moved to position 2 at step r in FIG. 8 and capping processing is performed at step s in FIG. 8.

II. To print in black ink using only the first printing head 7 with the second printing head 8 set to non-operation mode:

When the power is turned on, the stop period is determined according to time count data from the stop timer (not shown) and if the stop time is long, a negative pressure of the pump 37 is given via the cap member 31 to the first printing head 7 involved in printing forcibly discharging ink drops only from the printing head 7, thereby recovering the ink jetting capability.

The forcible discharge operation of ink drops from the second printing head 8 not involved in printing is thus stopped, whereby ink consumption can be suppressed. Such stopping of forcible jetting of ink drops can be easily set by setting the setup time of the stop timer for the second printing head 8 to infinity.

When a print signal is input at step a in FIG. 7, again a negative pressure is given to the first printing head 7 as required for recovering the ink jetting capability before the previous mode stored in the print mode storage means 82 is read by the mode detection means 81 and is set to the current print mode at step b in FIG. 7.

At this stage, when "monochrome" print and "stopping of idle jetting of unused head" are selected through the mode setting means 80 to change the print mode at steps c and d in FIG. 7, the maintenance control means 70 executes operation 1 at step i in FIG. 8.

Figure 9:
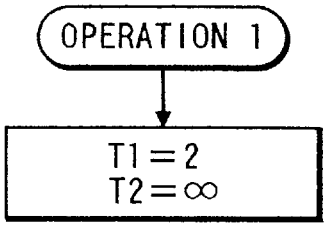
FIG. 9 is a flowchart to show a process of operation 1 in print mode.

That is, the idle jetting period of the first printing head 7, T1, is set to two seconds and the idle jetting period of the second printing head 8, T2, is set to infinity in FIG. 9. After the setting, the data is written into the print mode storage means 82 at step o in FIG. 7 and the TM timer 72 is reset, then started at step p in FIG. 7. Control jumps to step a in FIG. 8 at which the first and second timers 73 and 74 are reset, then started.

In this state, when a print signal is input, black ink is jetted from the nozzle openings of the first printing head 7 and printing is started at step b in FIG. 8.

When the first timer 73 counts the shortest idle jetting period T1 at step c in FIG. 8, the maintenance control means 70 waits for a one reciprocation end signal from the print process monitor means 71 at step e in FIG. 8. If 1-reciprocation printing terminates at step e in FIG. 8 before the expiration of predetermined time required for 1-reciprocation printing, ΔT, for example, one second at step d in FIG. 8 after the first timer 73 counts the shortest idle jetting period T1, the maintenance control means 70 determines whether or not the time count data t2 of the second timer 74 exceeds the shortest idle jetting period T2 of the second printing head 8 stored in the maintenance data storage means 75 (in the embodiment, infinity) at step f in FIG. 8.

In this case, since the reciprocating printing is terminated at a lapse of two seconds since the start of the printing, the time has elapsed by ΔT; after all, the time of only 2.5 seconds has elapsed since the start of the printing. Thus, the maintenance control means 70 causes the carriage control means 76 to move the first printing head 7 to position 1 (c in FIG. 15) facing the second cap member 32 positioned on the print area side at step g in FIG. 8.

In this state, the maintenance control means 70 reads the number of jetted ink drops corresponding to the time t1 counted by the first timer 73 at step h in FIG. 8 and causes ink drops to be jetted from all nozzle openings of the first printing head 7 at steps i and j in FIG. 8.

When idle jetting of the first printing head 7 terminates, the maintenance control means 70 resets the first timer 73 and causes it to again start counting the time at step k in FIG. 8. In this case, print data remains at step 1 in FIG. 8 because of idle jetting during the printing. Therefore, the carriage 1 is moved to the print area and printing is restarted at step b in FIG. 8.

When again the first timer 73 counts the shortest idle jetting period T1 at step c in FIG. 8 in the next print process, control goes to step f via steps d and e. In this case, the second printing head 8 is set to the non-operation mode, thus the idle jetting operation is executed only based on the time count data of the first timer 73 independently of the time count data of the second timer 74.

Thus, useless ink jetting operation of the second printing head 8 not used for printing is eliminated for suppressing consumption of color ink and shortening the print stop period required for jetting, whereby the running cost can be decreased and the printing speed can be improved.

After this, the printing is continued while the steps are repeated. When print data runs out at step 1 in FIG. 8, the carriage 1 is moved to position 2 at step r in FIG. 8 and capping processing is performed at step s in FIG. 8.

By the way, the second printing head 8 is stopped in print operation and need not perform idle jetting operation during the print period and the cap member 32 for the head 8 is positioned on the print area side. Thus, if idle jetting during the print period of the first printing head 7 is performed for the cap member 32 for the second printing head 8, the move distance of the first printing head 7 for idle jetting is shortened, so that the printing speed of the first printing head 7 is improved.

III. To print using the second printing head 8 for color printing in stop state together with the first printing head 7:

When color (YMC) printing is selected through the mode selection means 80 at steps c and e in FIG. 7, operation 2 is executed at step j in FIG. 7.

Figure 10:
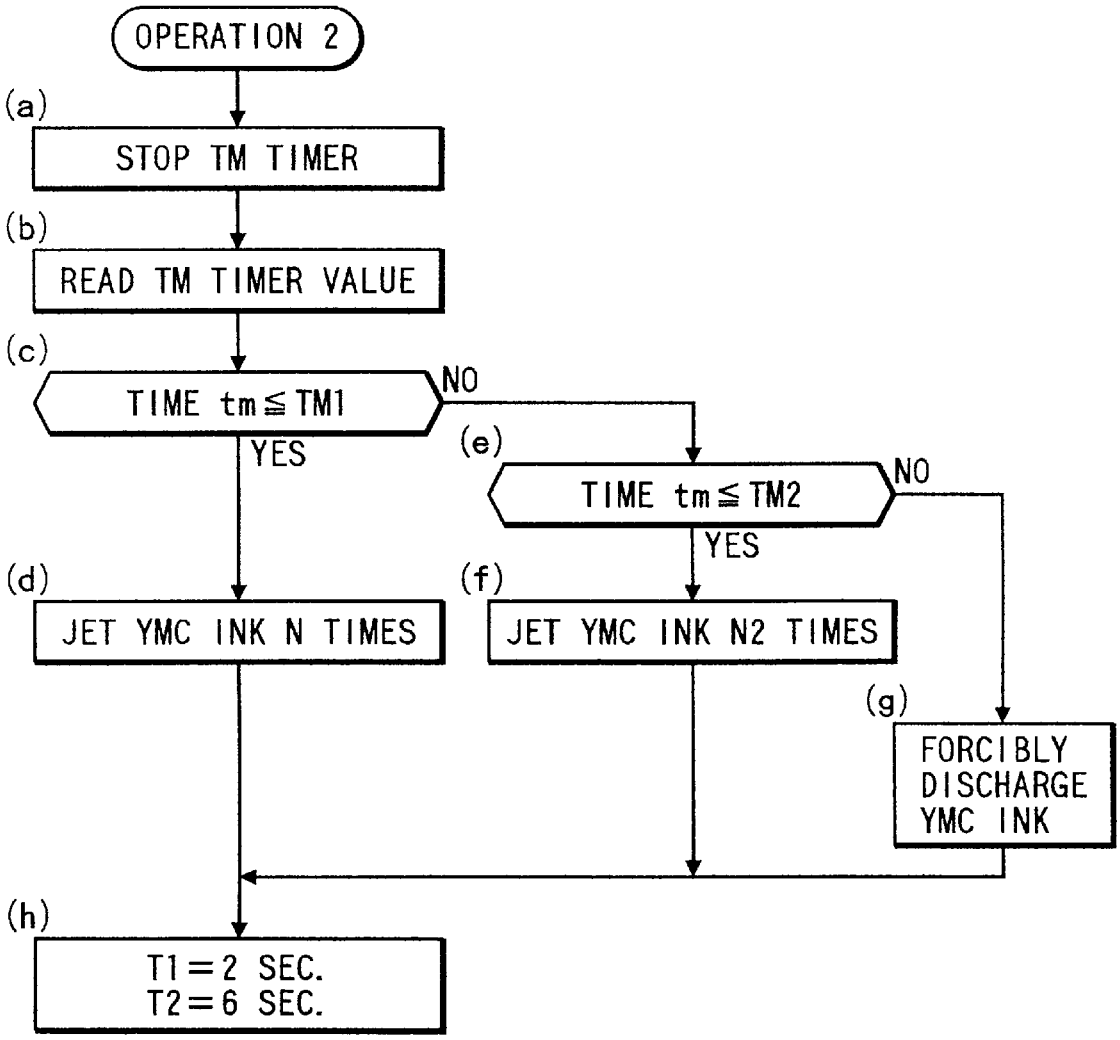
FIG. 10 is a flowchart to show a process of operation 2 in print mode.

That is, the time for which the second printing head 8 has been placed in the stop state, tm, is read from the TM timer 72 at step b in FIG. 10. If the time tm is less than comparatively short time TM1, for example, five hours at step c in FIG. 10, the maintenance control means 70 causes YMC color ink to be idly jetted N1 times from the second printing head 8 based on the data stored in the maintenance data storage means 75 at step d in FIG. 10.

If the time count data tm of the TM timer 72 is comparatively large (TM1<tm<TM2, in the embodiment, five hours or more and less than 10 hours) at step e in FIG. 10, YMC color ink is jetted N2 times greater than N1 times from the second printing head 8 at step f in FIG. 10.

Further, if the time count data tm of the TM timer 72 is very large (tm>TM2, in the embodiment, 10 hours or more) at step e in FIG. 10, the pump 38 is operated with the second printing head 8 capped for selectively giving a negative pressure only to the second printing head 8 before forcibly discharging YMC color ink at step g in FIG. 10.

Since the ink cartridge is mounted on the carriage 1 in the embodiment, a negative pressure of the pump 38 is given with the printing head sealed with the cap member. However, in a recording apparatus comprising an ink tank installed on a cabinet for supplying ink to a printing head by an ink supply pump, the ink supply pressure of the ink supply pump may be increased.

If YMC color ink is thus jetted or forcibly discharged in response to the stop time tm of the second printing head 8, a film formed by drying in the proximity of the nozzle openings is blown up together with ink, removing clogging of the second printing head 8.

At the termination of the jet recovery operation of the second printing head 8, the idle jetting periods of the first and second printing heads 7 and 8 at the printing time are set to values appropriate for printing, namely, T1=two seconds and T2=six seconds at step h in FIG. 10.

Since such operation enables the first and second printing heads 7 and 8 to be used for printing, black ink and YMC color ink can be used for printing by executing the same steps as in the mode I described above.

IV. To print by stopping the first printing head 7 from the printing state with the first and second printing heads 7 and 8 and using only the second printing head 8:

When the power is turned on, the stop period is determined according to time count data from the stop timer (not shown) and if the stop time is long, a negative pressure of the pump 38 is given via the cap member 32 to the first printing head 8 involved in printing forcibly discharging ink drops only from the printing head 8, thereby recovering the ink jetting capability.

The forcible discharge operation of ink drops from the second printing head 7 not involved in printing is thus stopped, whereby ink consumption can be suppressed. Such stopping of forcible jetting of ink drops can be easily set by setting the setup time of the stop timer for the second printing head 7 to infinity.

When a print signal is input at step a in FIG. 7, the mode detection means 81 reads the previous mode stored in the print mode storage means 82 and sets it to the current print mode at step b in FIG. 7. At this stage, when "color (YMC)" print and "stopping of idle jetting of unused head" are set through the mode setting means 80 to change the print mode at steps c and e in FIG. 7, the maintenance control means 70 executes operation 3 at step k in FIG. 8.

Figure 11:
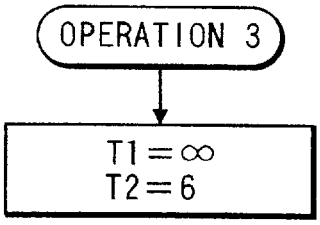
FIG. 11 is a flowchart to show a process of operation 3 in print mode.

That is, the idle jetting period of the first printing head 7, T1, is set to infinity and the idle jetting period of the second printing head 8, T2, is set to six seconds in FIG. 11. After the setting, the data is written into the print mode storage means 82 at step o in FIG. 7 and the TM timer 71 is reset, then started at step p in FIG. 7. Control jumps to step a in FIG. 8 at which the first and second timers 73 and 74 are reset and started at step p in FIG. 7.

In this state, when a print signal is input, YMC color ink is jetted from the nozzle openings of the second printing head 8 and printing is executed at step b in FIG. 8.

When the second timer 74 counts the shortest idle jetting period T2 at step f in FIG. 8, the maintenance control means 70 moves the second printing head 8 to position 2 (d in FIG. 15) facing the second cap member 32 at step m in FIG. 8.

In this state, the maintenance control means 70 reads the number of jetted ink drops corresponding to the time t2 counted by the second timer 74 at step n in FIG. 8 and causes ink drops to be jetted from all nozzle openings of the second printing head 8 at steps o and p in FIG. 8.

After this, idle jetting is executed only for the second printing head 8 based only on the time count data of the second timer 74 independently of the time count data of the first timer 73. In this case, therefore, sequences concerning the second printing head 8 using the first timer 73 are not executed.

V. To print using the first printing head 7 in stop state together with the second printing head 8:

When "color (BYMC)" printing is selected through the mode selection means 80 at steps c and g in FIG. 7, operation 4 is executed at step 1 in FIG. 7.

Figure 12:
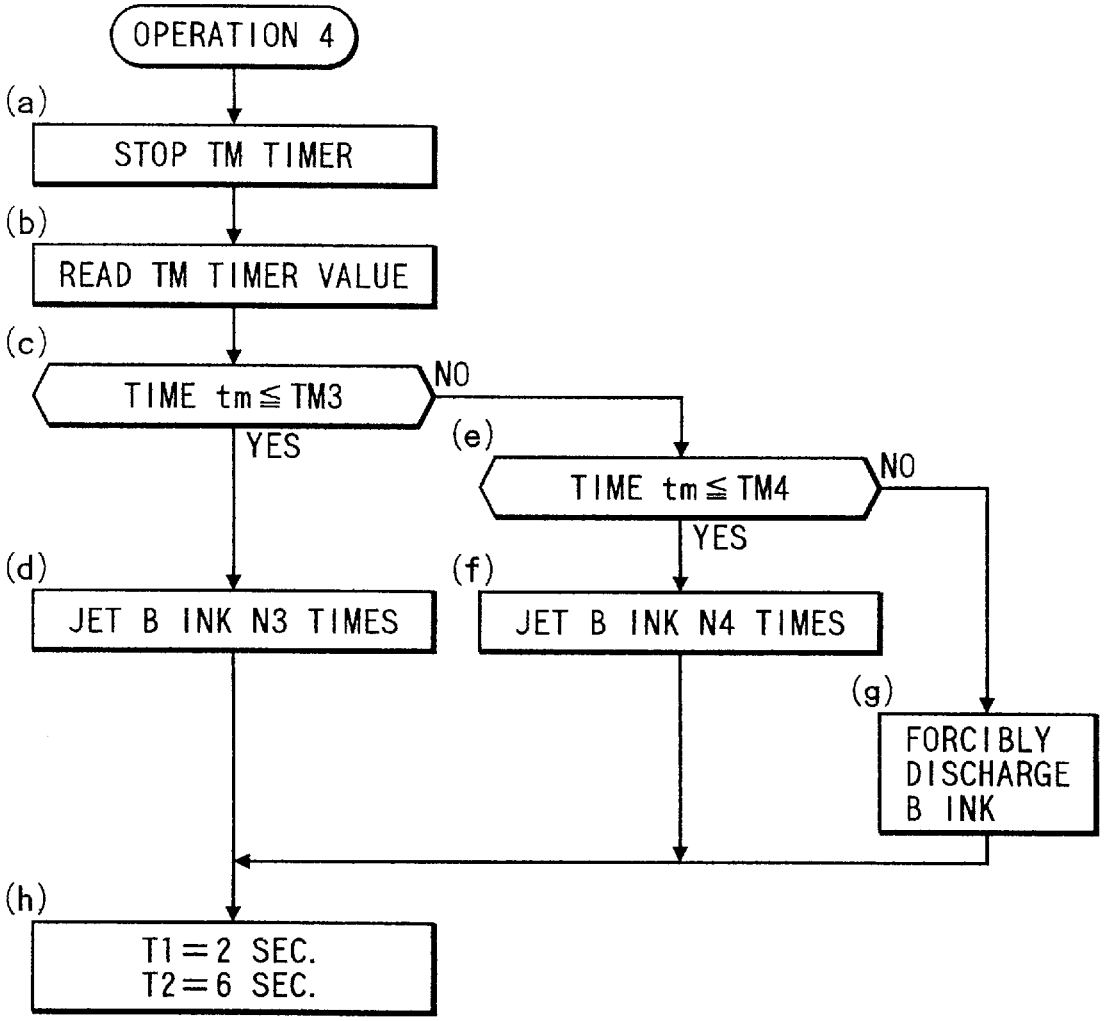
FIG. 12 is a flowchart to show a process of operation 4 in print mode.

That is, the operation of the TM timer 72 is stopped at step a in FIG. 12 and the time for which the first printing head 7 has been placed in the stop state during the mode IV, tm, is read from the TM timer 72 at step b in FIG. 12. If the time tm is less than comparatively short time TM3 at step c in FIG. 12, the maintenance control means 70 causes black ink to be idly jetted N3 times from the first printing head 7 based on the data stored in the maintenance data storage means 75.

If the time count data tm of the TM timer 72 is comparatively large (TM3<tm<TM4) at step e in FIG. 12, black ink is jetted N4 times greater than N3 times from the first printing head 7 at step f in FIG. 12.

Further, if the time count data tm of the TM timer 72 is very large (tm>TM4), only the pump 37 is operated with the first printing head 7 capped for selectively giving a negative pressure only to the first printing head 7 for forcibly discharging black ink at step g in FIG. 12

Black ink is thus jetted or forcibly discharged in response to the stop time tm of the first printing head 7, thereby removing clogging of the first printing head 7.

At the termination of the jet recovery operation of the first printing head 7, the idle jetting periods of the first and second printing heads 7 and 8 at the printing time are set to values appropriate for printing, namely, T1=two seconds and T2=six seconds at step h in FIG. 12.

Since such operation enables the first and second printing heads 7 and 8 to be used for printing, black ink and YMC color ink can be used for printing by executing the same steps as in the mode I described above.

VI. To execute monochrome printing using only the first printing head 7 from the printing state only with the second printing head 8 for color printing:

When "monochrome" printing is selected through the mode selection means 80 at steps c and h in FIG. 7, operation 5 is executed at step m in FIG. 7.

That is, the operation of the TM timer 72 is stopped at step a in FIG. 13 and the time for which the first printing head 7 has been placed in the stop state in the immediately previous setting, tm, is read at step b in FIG. 13.

If the time tm is less than comparatively short time TM3, at step c in FIG. 13, the maintenance control means 70 causes N3 ink drops to be idly jetted from the first printing head 7 based on the data stored in the maintenance data storage means 75.

If the time count data tm of the TM timer 72, is comparatively large (TM3<tm<TM4) at step e in FIG. 13, N4 ink drops greater than N3 ink drops are jetted from the first printing head 7 at step f in FIG. 13.

Further, if the time count data tm of the TM timer 72 is very large (tm>TM4) at step g in FIG. 13, only the pump 37 is operated with the first printing head 7 capped for forcibly discharging ink from the first printing head 7.

Black ink is thus idly jetted or discharged in response to the stop time, whereby the first printing head 7 clogged during the stop can be recovered to a printable state.

At the termination of the jet recovery operation of the first printing head 7, the idle jetting period of the first printing head 7 at the printing time is set to a value appropriate for printing, namely, T1=two seconds and the idle jetting period T2 of the second printing head 8 is set to infinity at step h in FIG. 13.

Since such operation enables the first printing head 7 to be used for printing and the second printing head 8 to be placed in the stop state, monochrome printing can be performed at high speed while color ink is saved without idle jetting of the second printing head 8 by executing the same steps as in the mode II described above.

Since the second printing head 8 is not involved in the print operation, ink consumption at the second printing head 8 not involved in the print operation can be suppressed by also stopping the forcible discharge operation of ink drops for the second printing head 8 when the power is turned on or at the print start time.

VII. To print using only the second printing head 8 for color printing in stop state while the first printing head 7 is stopped:

When "color (YMC)" printing is selected through the mode selection means 80 at steps c and h in FIG. 7, operation 6 is executed at step n in FIG. 7.

Figure 14:
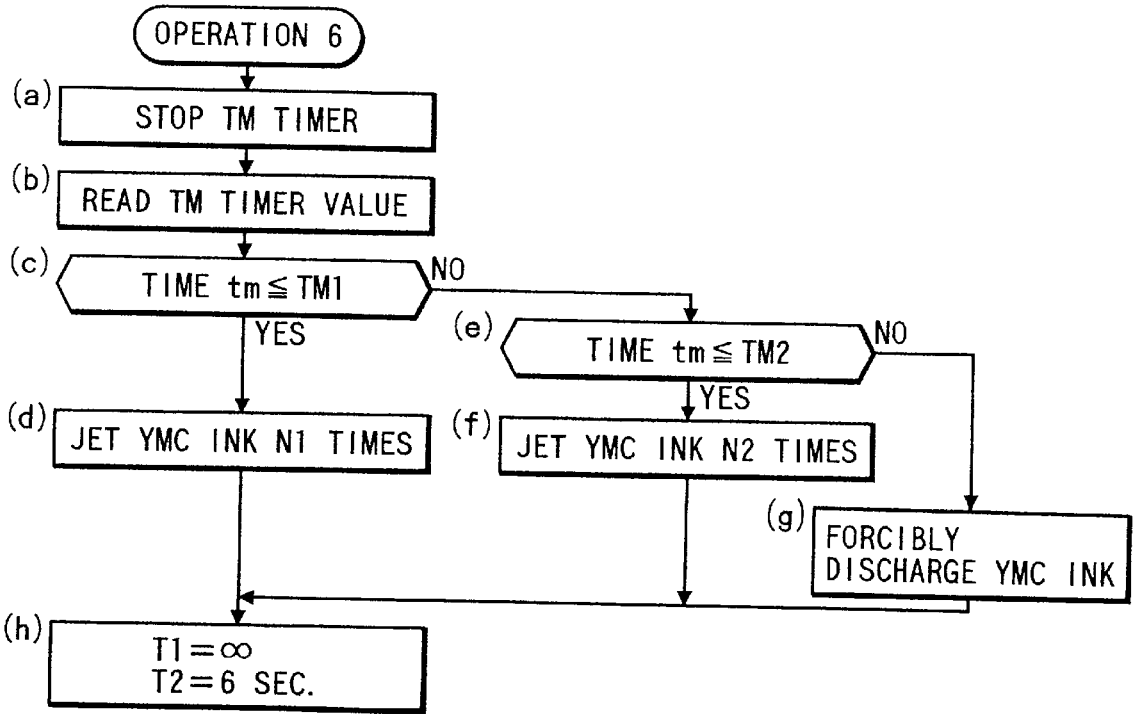
FIG. 14 is a flowchart to show a process of operation 6 in print mode.
Figures 15A, 15B, 15C, 15D:
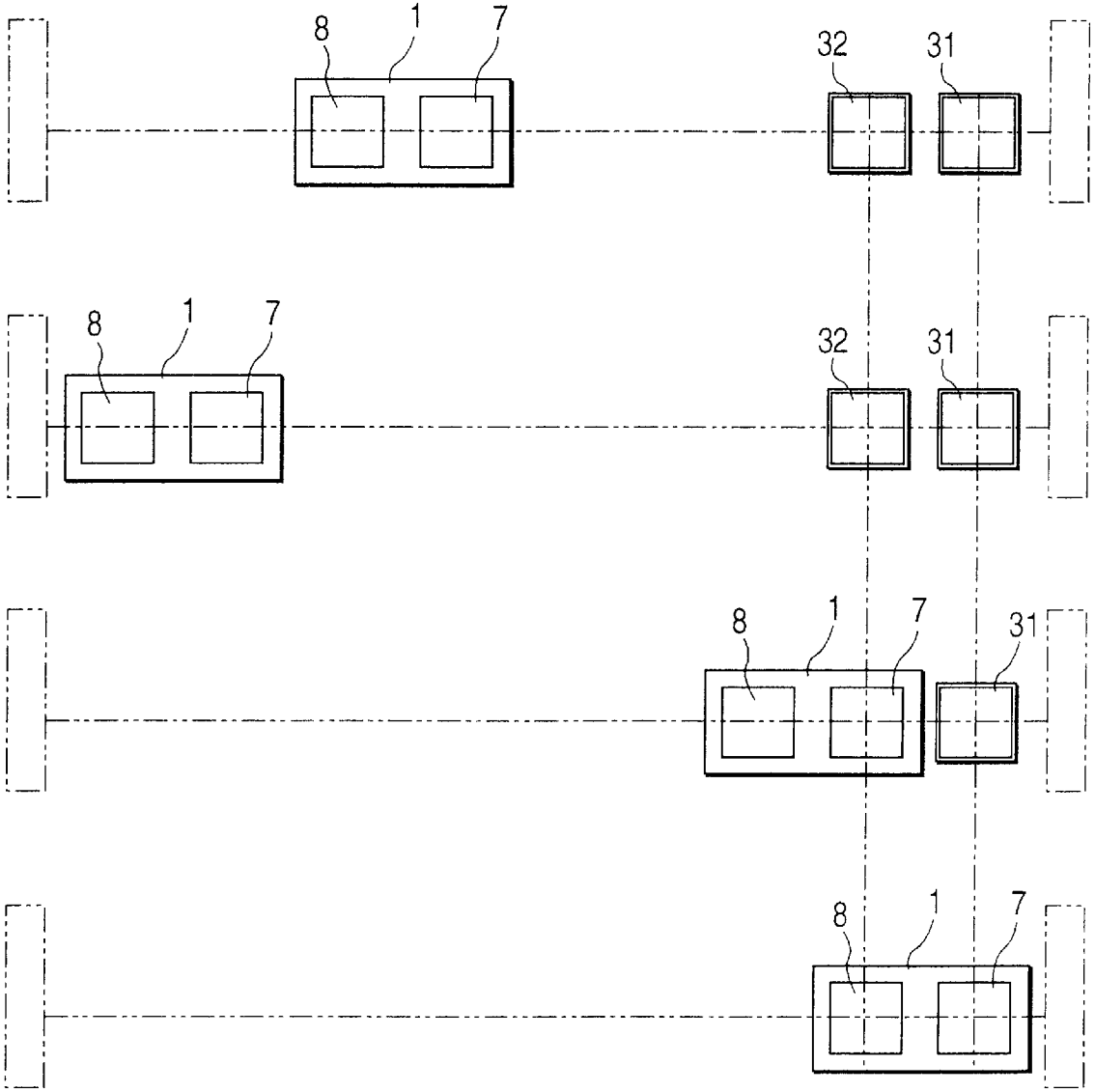
FIGS. 15(*a*) to 15(*d*) are illustrations to show carriage motion in the ink jet recording apparatus.

That is, the operation of the TM timer 72 is stopped at step a in FIG. 14 and the time for which the second printing head 8 has been placed in the stop state during the mode IV, tm, is read from the TM timer 72 at step b in FIG. 14. If the time tm is less than comparatively short time TM1 at step c in FIG. 14, the maintenance control means 70 causes YMC color ink to be idly jetted N1 times from the second printing head 8 based on the data stored in the maintenance data storage means 75.

If the time count data tm of the TM timer 72 is comparatively large (TM1<tm<TM2) at step e in FIG. 14, YMC color ink is jetted N2 times greater than N1 times from the second printing head 8 at step f in FIG. 14.

Further, if the time count data tm of the TM timer 72 is very large (tm>TM2), the pump 38 is operated with the second printing head 8 capped for forcibly discharging YMC color ink only from the second printing head 8.

YMC color ink is thus idly jetted or forcibly discharged in response to the stop time tm of the second printing head 8, thereby removing clogging of the second printing head 8.

At the termination of the jet recovery operation of the second printing head 8, the idle jetting period of the second printing head 8 at the printing time is set to a value appropriate for printing, namely, T2=six seconds and the idle jetting period T1 of the first printing head 7 is set to infinity at step h in FIG. 14.

Since such operation enables the second printing head 8 to be used for printing, only YMC color ink can be used for printing by executing the same steps as in the mode IV described above.

By the way, the idle jet operation of the printing head placed in the non-operation mode is stopped by selecting a print mode in the embodiment. However, when the selected print mode is complete in a short time, if ink is idly jetted from the printing head placed in the non-operation mode as well as the printable printing head, immediate printing is enabled. Thus, it is desirable that such a mode can be set.

Although the ink jetting capability of the printing head stopped in the print operation is recovered only by jetting and forcibly discharging ink drops in the embodiment, the operation of rubbing or wiping the nozzle plate by the cleaning member 14 in response to the value of the TM timer 72 is added as required, whereby the amount of ink consumed in jetting and forcibly discharging can be decreased.

Figure 16:
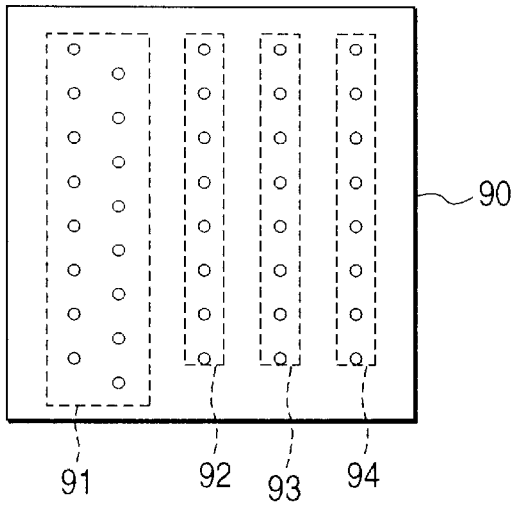
FIG. 16 is an illustration to show one embodiment of a printing head to which the invention can be applied, with an arrangement structure of nozzle opening rows.

We have discussed the embodiment by taking the recording apparatus comprising the printing head for monochrome printing and that for color printing physically independent of each other as an example. For a recording head comprising nozzle opening rows 91 for jetting black ink and nozzle opening rows 92, 93, and 94 for jetting cyan, magenta, and yellow color inks formed on a single board 90, as shown in FIG. 16, the above-described control can also be applied for each of the nozzle opening rows 91 to 94 or for each of black and color groups.

With a printing head comprising an alternating pattern of nozzle openings for jetting different color inks arranged in a straight line, ink can be forcibly discharged by ink supply pump for supplying color inks, thus the above-described control can also be applied.

The mode selection means is made up of switches disposed in the main unit of the recording apparatus in the embodiment. However, a similar effect can be produced if a setting dialog 100 for displaying the print mode and idle jetting mode as shown in FIG. 17 is part of a printer driver in a personal computer and mode option buttons 101 to 105 are used to set the modes.

Figure 17:
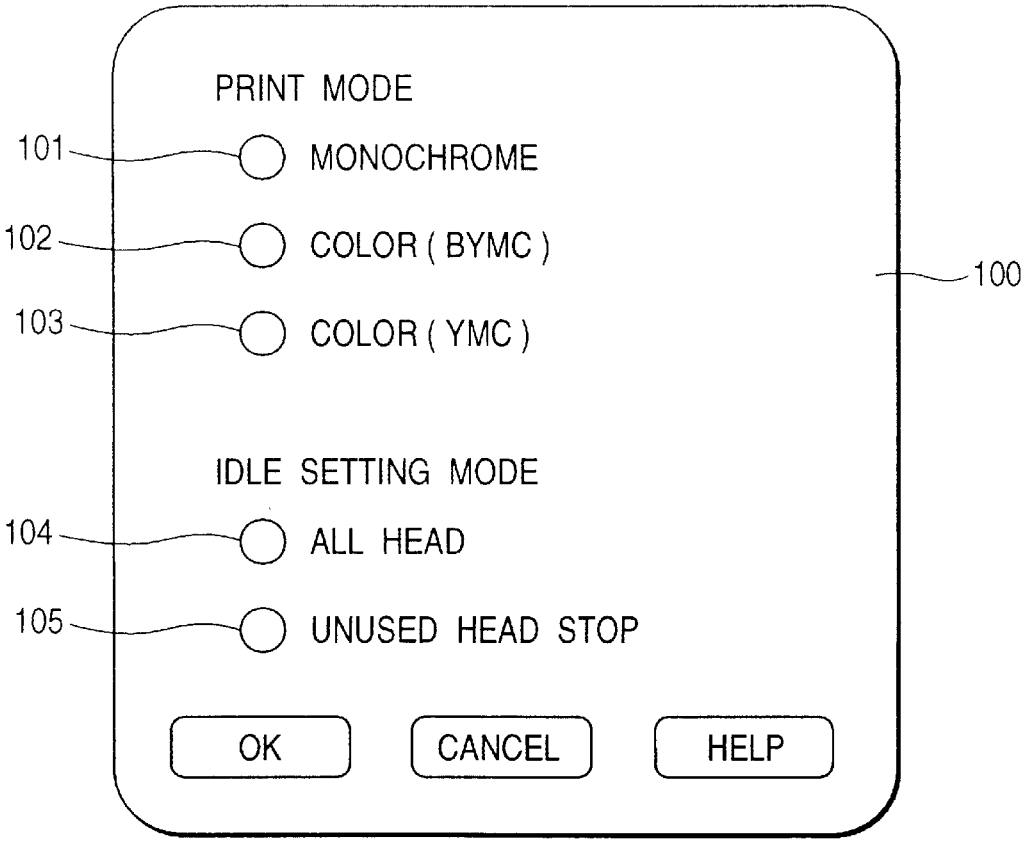
FIG. 17 is an illustration to show another embodiment of the invention.

The "ALL HEADS" button in the idle jetting mode in FIG. 17 is set to cause the printing head deactivated by print mode selection to execute idle jetting for eliminating the need for the jetting recovery operation and immediately enabling the printing head to be used for printing to again use the printing head. The "UNUSED HEAD STOP" button in FIG. 17 is set to stop the idle jetting operation of the deactivated printing head for preventing idle jetting from consuming ink and lowering the printing speed.

If the print operation on at least one nozzle opening row is stopped by print mode selection, a mode for automatically stopping the idle jetting operation for the nozzle opening row or the forcible ink drop jetting operation by capping as required is set to default and a mode for the user to release it can also be provided.

As we have discussed, according to the invention, there is provided an ink jet recording apparatus including a printing head having a plurality of nozzle opening rows for jetting ink drops separately from each other, a cap for selectively sealing the nozzle opening rows and a pressure device for forcibly discharging ink from the nozzle opening rows, and a controller means for causing the cap to seal the nozzle opening rows and the pressure device to forcibly discharge ink from the nozzle opening rows, thereby performing a jetting recovery operation when power is turned on or at a print start time, for causing ink drops to be jetted from the nozzle opening rows based on print data during printing and stopping the printing for performing an ink jetting capability maintaining operation of the nozzle opening rows, and further causing the cap to seal the nozzle opening rows and the pressure device to forcibly discharge ink from the nozzle openings, thereby performing the jetting recovery operation. The controller is capable of stopping the printing operation and the ink jetting capability maintaining operation for at least one of the nozzle opening rows during the printing operation for another row. Thus, the jetting operation of ink drops from the nozzle opening row in which the printing operation is stopped saves ink and eliminates the need for time required for the jetting, thereby improving the printing speed.

What is claimed is:

1. An ink-jet recording apparatus comprising:

a plurality of nozzle opening rows for jetting ink, which are provided on a recording head slid between a printing area and a non-printing area reciprocally;

a control section for moving the recording head to the printing area to jet the ink from the nozzle opening rows under a printing operation, and for moving the recording head to the non-printing area to jet the ink idly from the nozzle opening rows under predetermined conditions;

a capping member disposed at the non-printing area for sealing the respective nozzle opening rows under a stand-by condition, and for receiving the idly jetted ink in front of the nozzle opening rows;

setting means for setting one of an operation and a stand-by for the respective nozzle opening rows;

setting storing means for storing the present setting and at least one previous setting set by the setting means;

setting preparation means for preparing the present setting and the previous setting to judge how the setting has been changed;

idle ink jetting period setting means for automatically setting a minimum idle ink jetting period with respect to each of the nozzle openings in accordance with the judgement of the setting preparation means.

2. The ink-jet recording apparatus as set forth in claim 1, wherein the control section operates all the nozzle opening rows to jet the ink idly when the apparatus is booted and the printing is started, and operates the nozzle opening rows set as the operation opening rows to jet the ink idly while pausing the printing operation at predetermined periods.

3. The ink-jet recording apparatus as set forth in claim 2, further comprising:

a first timer section for measuring a period from the previous idle ink jetting with respect to each of the nozzle openings, wherein the control section determines an amount of the idle jetting ink in accordance with the period measured by the first timer section.

4. The ink-jet recording apparatus as set forth in claim 3, further comprising:

a first table storing section for storing a data table indicating a relationship between the period from the previous idle ink jetting and the amount of the idle jetting ink, wherein the control section determines the amount of the idle jetting ink with reference to the data table stored in the first table storing section.

5. The ink-jet recording apparatus as set forth in claim 3, wherein the control section executes the printing operation while the period measured by the first timer section is shorter than the minimum idle ink jetting period set by the idle ink jetting period setting means, and stops the printing operation for executing the idle ink jetting of the operating nozzle rows when the period becomes not less than the minimum idle ink jetting period.

6. The ink-jet recording apparatus as set forth in claim 3, wherein the capping member seals all the nozzle opening rows when the period measured by the first timer section becomes a predetermined period which is longer than the minimum idle ink jetting period set by the idle ink jetting period setting means.

7. The ink-jet recording apparatus as set forth in claim 1, wherein the idle ink jetting period setting means set the minimum idle ink jetting period of the nozzle opening row set as the stand-by opening row to infinity.

8. The ink-jet recording apparatus as set forth in claim 1, wherein the setting means is capable of releasing the stand-by setting, and the control section executes the idle ink jetting of the nozzle opening row set as the stand-by opening row after the stand-by setting is released.

9. The ink-jet recording apparatus as set forth in claim 8, further comprising:

a second timer section for measuring a stand-by period of the stand-by nozzle opening row from the execution of the stand-by setting by the setting means, wherein the control section determines an amount of the idle jetting ink in accordance with the period measured by the second timer section.

10. The ink-jet recording apparatus as set forth in claim 9, further comprising:

a second table storing section for storing a data table indicating a relationship between the stand-by period and the amount of the idle jetting ink, wherein the control section determines the amount of the idle jetting ink with reference to the data table stored in the second table storing section.

11. The inkjet recording apparatus as set forth in claim 9, wherein the capping member seals the stand-by nozzle opening row and the control section applies a pressure to the sealed nozzle opening row to forcibly reduce the ink therefrom when the period measured by the second timer section exceeds a predetermined period.

12. The ink-jet recording apparatus as set forth in claim 9, further comprising:

a cleaning member for cleaning the nozzle opening rows, wherein the cleaning member cleans the stand-by nozzle opening when the period measured by the second timer section exceeds a predetermined period.

13. The ink-jet recording apparatus as set forth in claim 1, wherein the capping member includes a plurality of caps for sealing the respective nozzle opening rows, and if a nozzle opening row set as the operating opening row is closer than a nozzle opening row set as the stand-by opening row to the caps, the idle jetting ink of the operating nozzle opening row is received by a cap which is the closest to the printing area.

14. The ink-jet recording apparatus as set forth in claim 1, wherein the recording head includes a first recording head for jetting black ink and a second recording head for jetting cyan, magenta and yellow color ink, and the stand-by setting set by the setting means is applied to one of the first and second recording heads.

15. The ink-jet recording apparatus as set forth in claim 1, wherein the setting means is a setting signal input from at least one of switches provided on a body of the apparatus and a host computer connected to the apparatus.

* * * * *